US007160204B2

(12) United States Patent
Huang

(10) Patent No.: US 7,160,204 B2
(45) Date of Patent: Jan. 9, 2007

(54) CONNECTING STRUCTURE FOR A STRIKING PLATE OF A GOLF CLUB HEAD

(75) Inventor: Chun-Yung Huang, Kaohsiung Hsien (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 47 days.

(21) Appl. No.: 10/776,526

(22) Filed: Feb. 12, 2004

(65) Prior Publication Data

US 2005/0181890 A1 Aug. 18, 2005

(51) Int. Cl.
*A63B 53/04* (2006.01)

(52) U.S. Cl. ..... 473/342; 473/350

(58) Field of Classification Search ..... 473/342
See application file for complete search history.

(56) References Cited

U.S. PATENT DOCUMENTS 4,792,139 A * 12/1988 Nagasaki et al. ..... 473/342
5,303,922 A * 4/1994 Lo ..... 473/330
5,713,800 A * 2/1998 Su ..... 473/342
5,967,903 A * 10/1999 Cheng ..... 473/342
6,117,023 A * 9/2000 Onuki et al. ..... 473/342
6,238,302 B1 * 5/2001 Helmstetter et al. ..... 473/340
6,273,832 B1 * 8/2001 Helmstetter et al. ..... 473/324
6,632,391 B1 * 10/2003 Helmstetter et al. ..... 264/319
6,780,124 B1 * 8/2004 Lu ..... 473/342

FOREIGN PATENT DOCUMENTS

JP 10192454 A * 7/1998
JP 10192457 A * 7/1998
TW 327606 3/1998
TW 469144 12/2001

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

A golf club head includes a body and a striking plate. The body includes a recess in a front side thereof. A plurality of positioning protrusions project from a perimeter of the striking plate. When the striking plate is inserted into the recess of the body, the positioning protrusions plastically deform and engage with an inner perimeter delimiting the recess, thereby positioning the striking plate in the recess and simplifying assembling and positioning for a subsequent welding procedure. In another embodiment, the positioning protrusions project from the inner perimeter delimiting the recess, and when the striking plate is inserted into the recess of the body, the positioning protrusions plastically deform and engage with the perimeter of the striking plate.

11 Claims, 6 Drawing Sheets

CONNECTING STRUCTURE FOR A STRIKING PLATE OF A GOLF CLUB HEAD

BACKGROUND OF THE INVENTION

1. Field of the Invention

The present invention relates to a connecting structure for a striking plate of a golf club head. In particular, the present invention relates to a connecting structure for connecting a striking plate to a body of a golf club head for simplifying assembling and positioning for a subsequent welding procedure.

2. Description of Related Art

Taiwan Patent Publication No. 327606 discloses a method for connecting a golf club head body and a striking plate, both made of metal. The golf club head body includes a recess for engaging with the striking plate. The recess includes a shoulder on which a welding material is placed. The striking plate is inserted into the recess and presses against the shoulder to cause deformation of a protruded portion on an inner edge of the shoulder, thereby filling the welding material into a gap defined between the striking plate, the shoulder, and the protruded portion. The welding material is in the form of metal powder and has a melting point lower than that of the golf club head body and that of the striking plate. The combination of the golf club head body and the striking plate is placed into a vacuum furnace or an inert gas atmosphere in a high temperature furnace and then heated at a temperature higher than the melting point of the welding material and lower than the melting point of the golf club head body and lower than the melting point of the striking plate. The molten welding material fills the tiny gaps between the golf club head and the striking plate by capillary action. A solid golf club head without welding marks on appearance is obtained after cooling.

Nevertheless, the gap between the striking plate, the shoulder, and the protruded portion can receive a limited amount of welding material, with a portion of the welding material filling the tiny gaps between an inner perimeter delimiting the recess and an outer perimeter of the striking plate. Thus, the remaining welding material is insufficient to fill the gap between the striking plate, the shoulder, and the protruded portion. Cavities are formed accordingly. As a result, when the striking plate is subjected to a striking stress and thus elastically deforms, cracks are apt to be generated in the welding areas. Further, the gap between the outer perimeter of the striking plate and the inner perimeter delimiting the recess must be precisely controlled to assure the welding material for braze welding to fill the tiny gaps by capillary action. Hence, additional equipment is required for milling the golf club head body and the striking plate so as to precisely control the tolerance of the gap regardless of the process for manufacturing the golf club head body and the striking plate (such as precision casting). The overall time for manufacturing the golf club head and the manufacturing cost are both increased, which is detrimental to mass production.

Taiwan Patent Publication No. 469144, a patent of addition of Taiwan Publication No. 327606, proposes an ordinary welding (such as argon welding) along a seam between the striking plate and the golf club head body after braze welding. Finally, the outer surface of the golf club head is subjected to grinding and surface finishing to guarantee the bonding strength by external welding. Nevertheless, the tolerance between the golf club head body and the striking plate requires precise control. Further, the overall time for manufacturing the golf club head and the manufacturing cost are both increased, which is detrimental to mass production.

OBJECTS OF THE INVENTION

An object of the present invention is to provide a connecting structure for connecting a striking plate to a body of a golf club head, thereby positioning the striking plate and simplifying assembling and positioning for a subsequent welding procedure. The bonding strength is improved, and the manufacturing cost is reduced.

Another object of the present invention is to provide a golf club head with improved welding strength.

A further object of the present invention is to provide a golf club head with an improved positioning effect for the striking plate.

SUMMARY OF THE INVENTION

In accordance with an aspect of the present invention, a golf club head comprises a body and a striking plate. The body includes a recess in a front side thereof. The striking plate includes a striking face on a front side thereof for striking a golf ball. A plurality of positioning protrusions project from a perimeter of the striking plate. When the striking plate is inserted into the recess of the body, the positioning protrusions plastically deform and engage with an inner perimeter delimiting the recess, thereby positioning the striking plate in the recess and simplifying assembling and positioning for a subsequent welding procedure.

In accordance with another aspect of the present invention, a golf club head comprises a body and a striking plate. The body includes a recess in a front side thereof. A plurality of positioning protrusions project from an inner perimeter delimiting the recess. The striking plate includes a striking face on a front side thereof for striking a golf ball. When the striking plate is inserted into the recess of the body, the positioning protrusions plastically deform and engage with a perimeter of the striking plate, thereby positioning the striking plate in the recess and simplifying assembling and positioning for a subsequent welding procedure.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
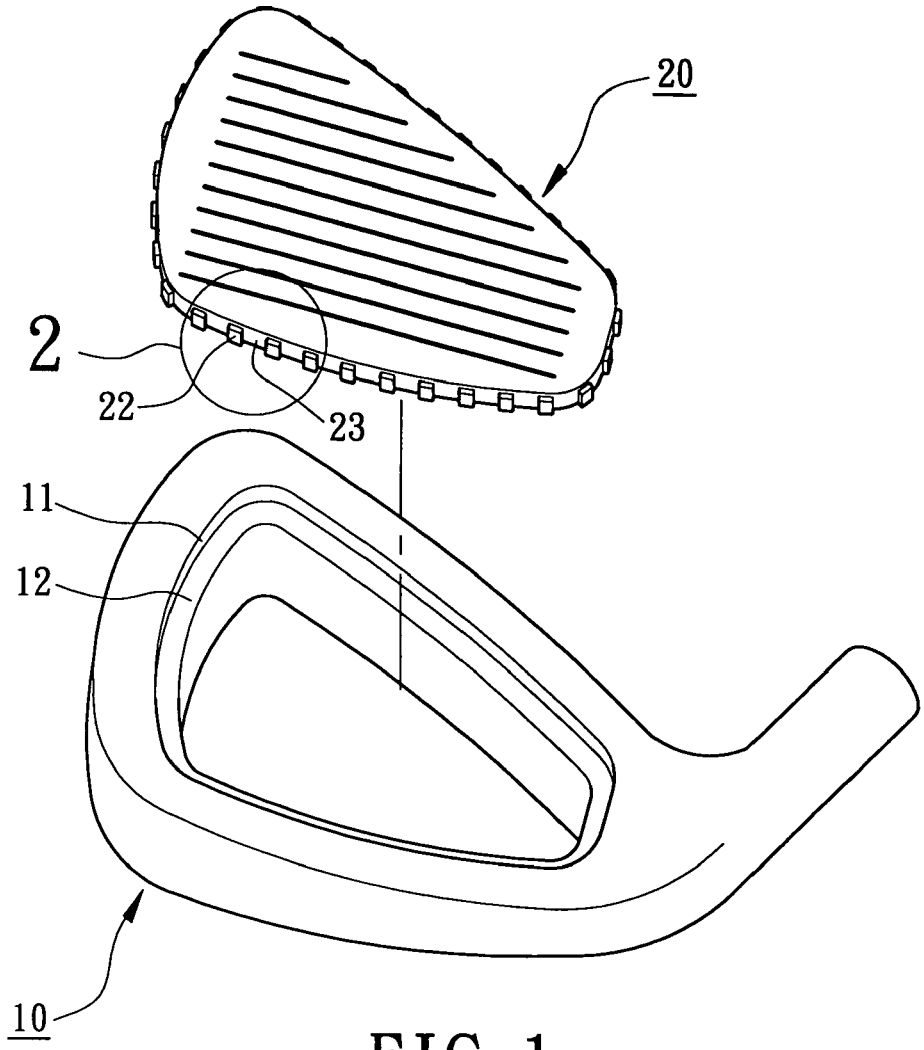
FIG. 1 is an exploded perspective view of a first embodiment of a golf club head in accordance with the present invention.
Figure 2:
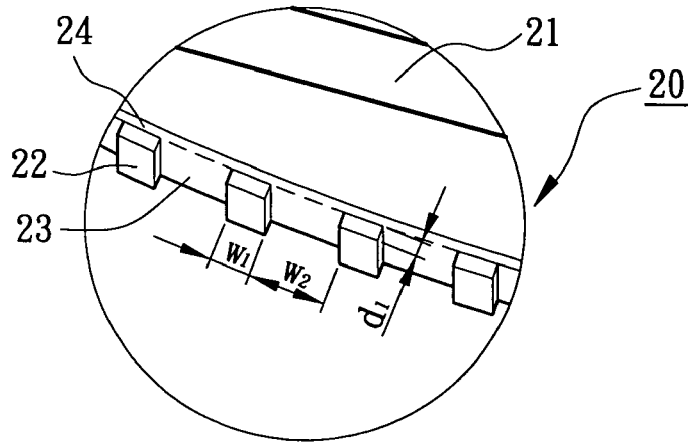
FIG. 2 is an enlarged view of a circled portion in FIG. 1.

Referring to FIGS. 1 and 2, a first embodiment of a golf club head in accordance with the present invention comprises a body 10 and a striking plate 20. The body 10 is made of stainless steel, carbon steel, or titanium alloy and has a recess 11. The recess 11 of the body 10 includes a stepped portion 12 extending inward from an inner perimeter delimiting the recess 11. The rear side of the recess 11 may be open or sealed.

Figure 3:
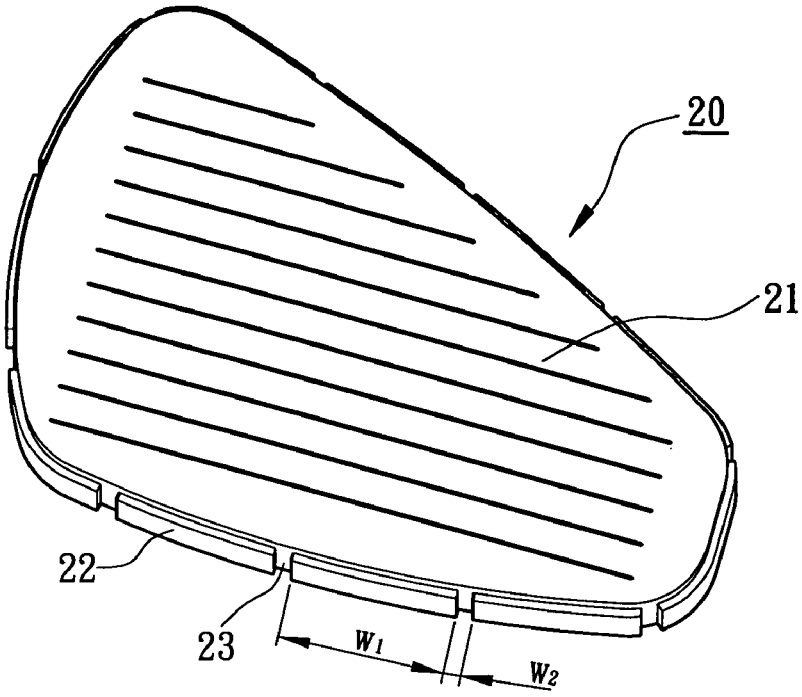
FIG. 3 is a perspective view of a striking plate, showing a modified embodiment of positioning protrusions.
Figure 4:
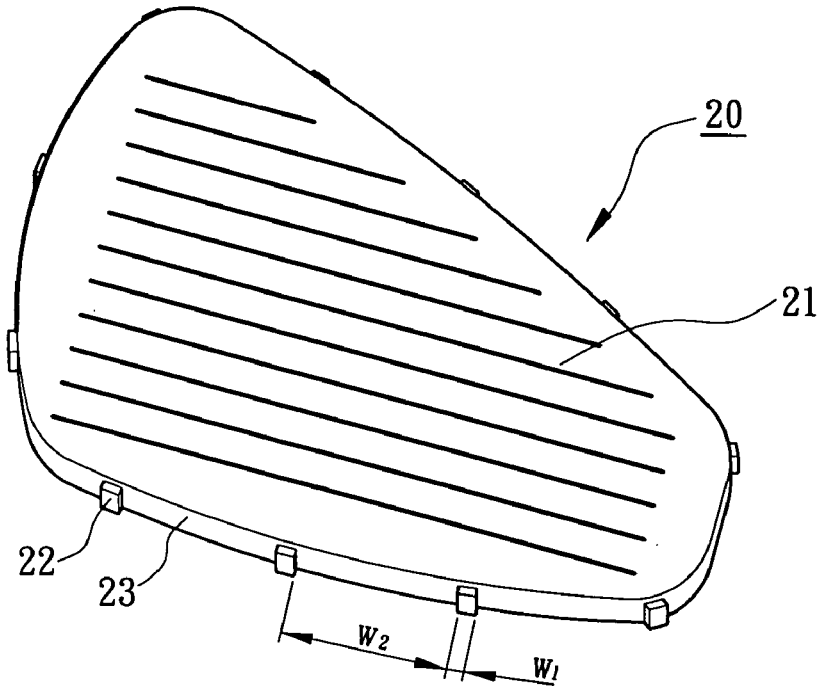
FIG. 4 is a view similar to FIG. 3, showing another modified embodiment of the positioning protrusions.

The striking plate 20 is made of titanium, titanium alloy, or stainless steel that has a good elastic deformability. The striking plate 20 includes a striking face 21 on a front side thereof for striking a golf ball. Further, a plurality of positioning protrusions 22 project from a perimeter of the striking plate 20, with a buffering space 23 being defined between two positioning protrusions 22 adjacent to each other. In this embodiment, each positioning protrusion 22 is a parallelepiped extending from a bottom edge of the perimeter of the striking plate 20 toward a top edge of the perimeter of the striking plate 20. As illustrated in FIG. 2, preferably, a space 24 for receiving filler is defined between each positioning protrusion 22 and the top edge of the perimeter of the striking plate 20. Further, a ratio of a width w1 of the respective positioning protrusion 22 to a width w2 of the respective buffering space 23 is preferably between 1:9 and 9:1. FIGS. 3 and 4 illustrate modified embodiments of the positioning protrusions 22, wherein the width w1 of each positioning protrusion 22 and the width w2 of each buffering space 23 are changed.

Figure 5:
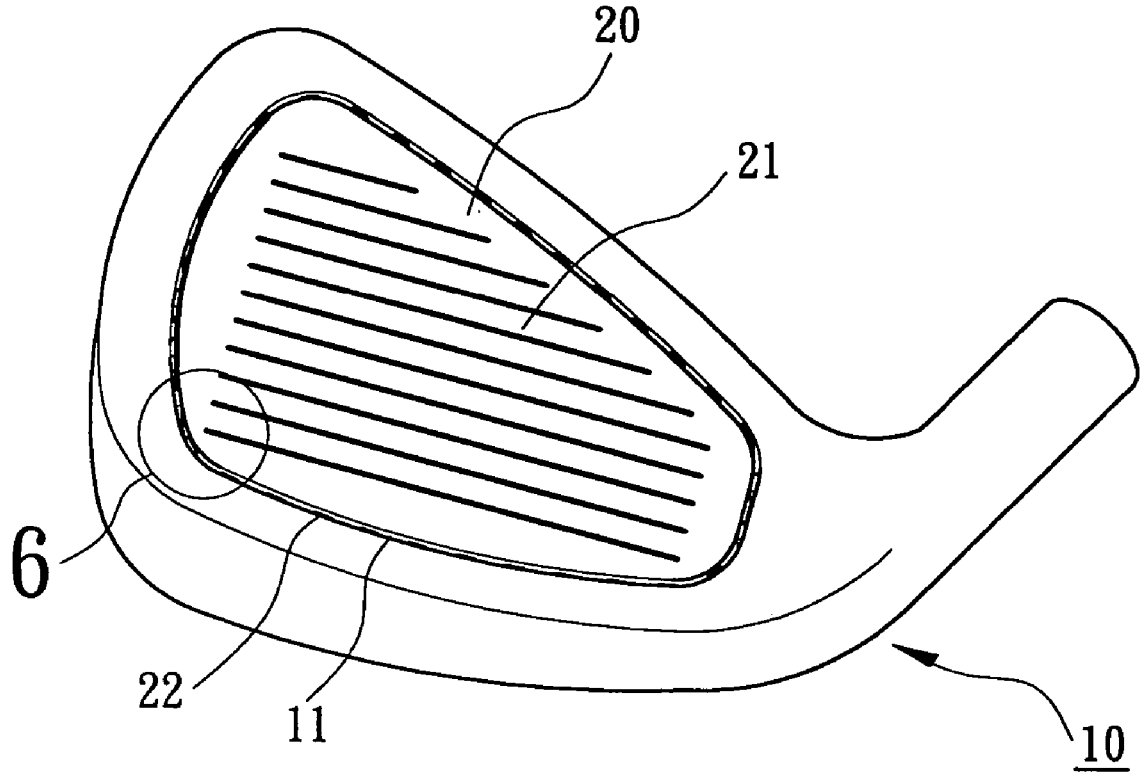
FIG. 5 is a perspective view of the first embodiment of the golf club head in accordance with the present invention.
Figure 6:
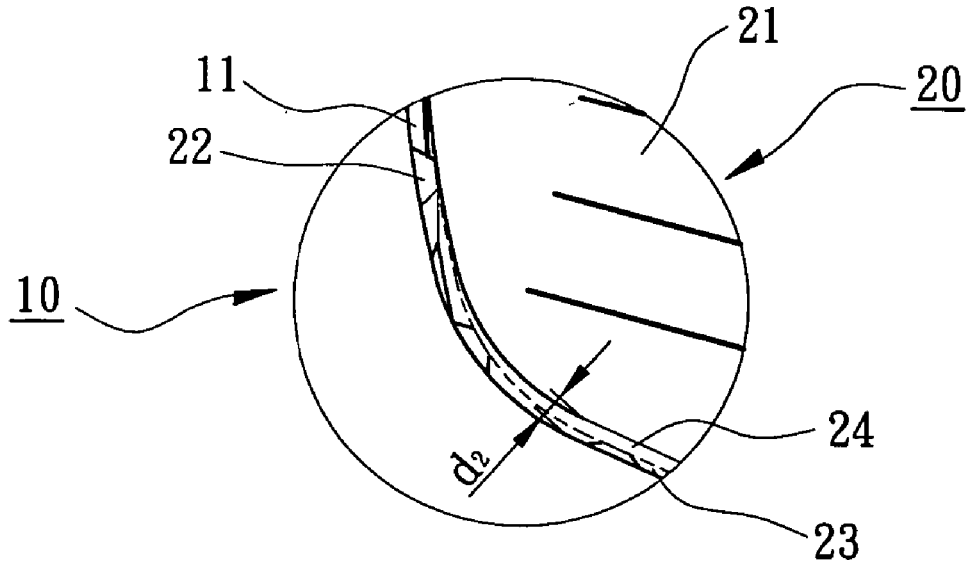
FIG. 6 is an enlarged view of a circled portion in FIG. 5.

Further, a thickness d1 of each positioning protrusion 22 is preferably greater than a distance d2 between the inner perimeter delimiting the recess 11 of the body 10 and the perimeter of the striking plate 20 (see FIGS. 5 and 6). For the respective positioning protrusion 22, the thickness d1 of the positioning protrusion 22 is about 0.5 mm, preferably 0.3 mm, and most preferably 0.2 mm. This thickness d1 provides a tolerance of subsequent plastic deformation while inserting the striking plate 20 into the recess 11 of the body 10.

As illustrated in FIGS. 5 and 6, since the thickness d1 of each positioning protrusion 22 is greater than the distance d2 between the inner perimeter delimiting the recess 11 of the body 10 and the perimeter of the striking plate 20, each positioning protrusion 22 has a portion located at a position outside the recess 11 when the striking plate 20 is aligned with the recess 11. When the striking plate 20 is inserted into the recess 11 of the body 10 by means of a pressing block (not shown), each positioning protrusion 22 plastically deforms for 0.5 mm–0.2 mm (or permanently deforms) and presses against the inner perimeter delimiting the recess 11 of the body 10. Thus, the striking plate 20 is fixedly and tightly engaged in the recess 11 of the body 10 and supported by the stepped portion 12 of the body 10. The reliable fixed engagement between the striking plate 20 and the body 10 can be maintained without the need of extra machines or tools while proceeding with a subsequent welding procedure. Namely, the assembling and positioning of the striking plate 20 and the body 10 can be simplified in the subsequent welding procedure. Thus, the golf club head in accordance with the present invention can be manufactured by various welding procedures, including manual welding and automated welding, such as braze welding, argon welding, or high-energy welding (such as laser welding, electric beam welding, or plasma welding).

The positioning protrusions 22 allow a larger tolerance in the striking plate 20 and the recess 11 of the body 10. Thus, the accuracy requirement for the body 10 and the striking plate 20 can be lowered. As a result, extra milling is hardly required regardless of the manufacturing procedure of the golf club head, such as precision casting, forging, pressing, or composite processing of different materials.

Figure 7:
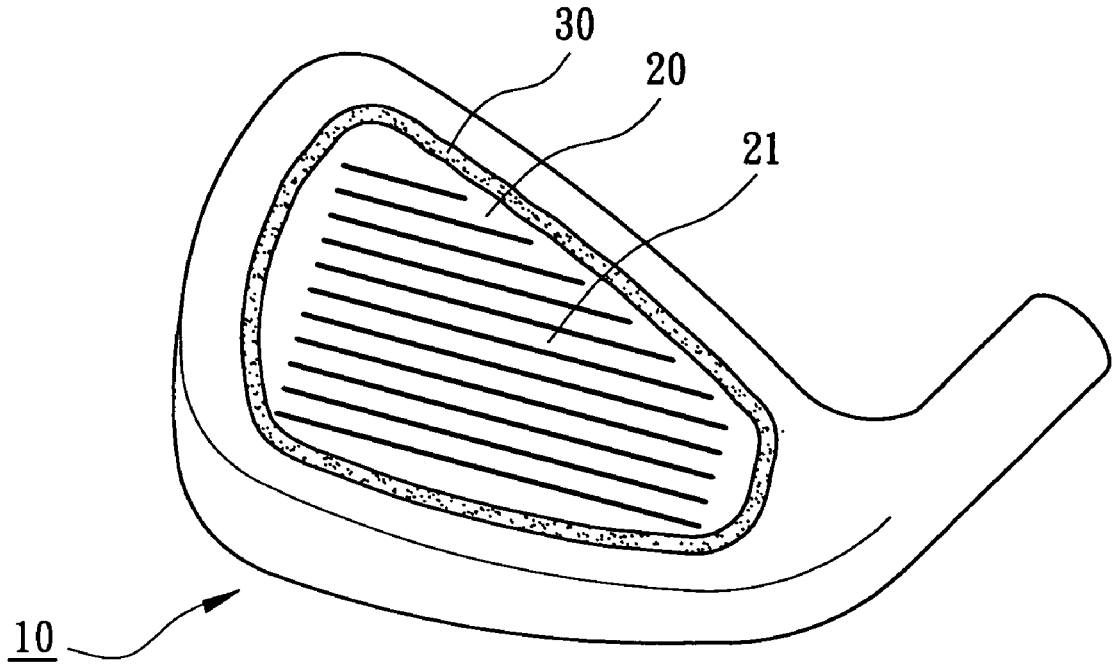
FIG. 7 is a perspective view of the golf club head after a welding procedure.

In a case that braze welding is adopted, in accordance with the present invention, the braze welding material (not shown) is filled into the spaces 24 for receiving filler and the buffering spaces 23 after the striking plate 20 is fixed in the recess 11 of the body 10 (see FIG. 6). Alternatively, the braze welding material is directly placed on top of the spaces 24 for receiving filler. The body 10 and the striking plate 20 fixedly engaged with each other are placed into a vacuum furnace a vacuum furnace or an inert gas atmosphere in a high temperature furnace and then heated. The molten braze welding material fills the tiny gaps between the striking plate 20, the inner perimeter delimiting the recess 11, and the stepped portion 12 by capillary action. As compared to the methods disclosed in Taiwan Patent Publication Nos. 327606 and 469144, the braze welding material needs not to be placed on the stepped portion 12 in advance in accordance with the present invention. The braze welding effect is reliable and the bonding strength is improved due to the capillary action that allows the braze welding material to be filled into the tiny gaps. Further, a welding bead 30 (FIG. 7) is formed after braze welding. Since the braze welding material in the welding bead 30 uniformly fills the spaces 24 for filler, the resultant golf club head product (not shown) after removal of the welding bead 30 has a uniform appearance.

Figure 8:
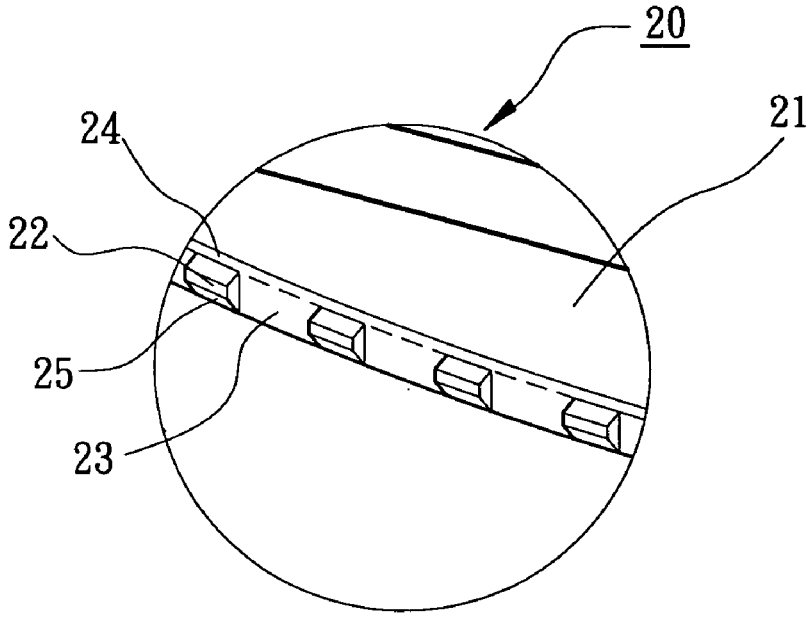
FIG. 8 is an enlarged view illustrating a further modified embodiment of the positioning protrusions.

FIG. 8 illustrates a modified embodiment of the positioning protrusions 22 in accordance with the present invention. In this embodiment, each positioning protrusion 22 is a trapezoid column. Further, each positioning protrusion 22 has an inclined face 25 on a bottom side thereof for guiding the positioning protrusion 22 into the recess 11 of the body 10. Thus, the striking plate 20 can be easily inserted into the recess 11 of the body 10 while avoiding damage to the edge delimiting the opening side of the recess 11.

Figure 9:
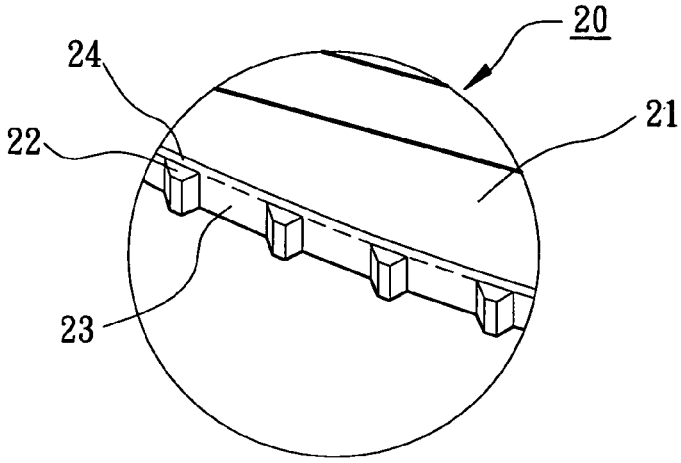
FIG. 9 is an enlarged view illustrating still another modified embodiment of the positioning protrusions.
Figure 10:
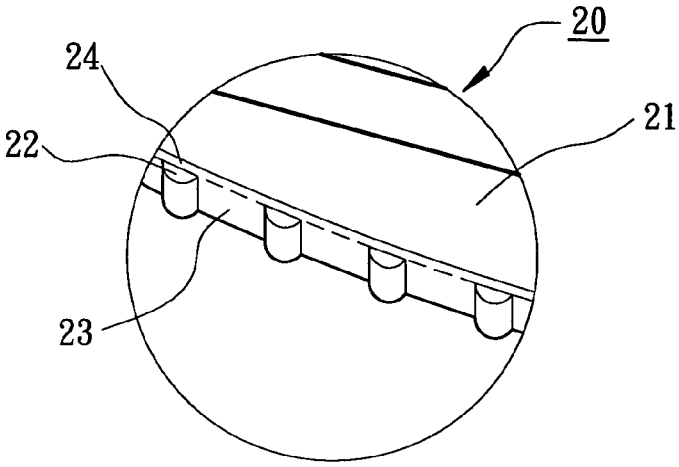
FIG. 10 is an enlarged view illustrating yet another modified embodiment of the positioning protrusions.
Figure 11:
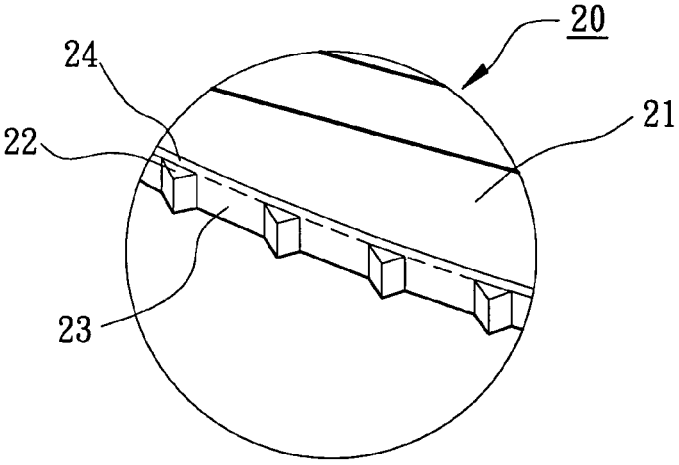
FIG. 11 is an enlarged view illustrating still another modified embodiment of the positioning protrusions.

FIG. 9 illustrates another modified embodiment of the positioning protrusions 22, wherein each positioning protrusion 22 is a trapezoid column located in another orientation. FIG. 10 illustrates a further modified embodiment of the positioning protrusions 22, wherein each positioning protrusion 22 is a semi-cylinder. FIG. 11 illustrates still another modified embodiment of the positioning protrusions 22, wherein each positioning protrusion 22 is a triangular prism. It is noted that the contact area between each positioning protrusion 22 and the inner perimeter delimiting the recess 11 of the body 10 is reduced. Thus, each positioning protrusion 22 easily enter the recess 11 of the body 10 without adversely affecting the positioning effect while the force required for pressing the striking plate 20 is reduced. Further, the positioning protrusions 22 of the striking plate 20 may have various shapes according to the product need.

Figure 12:
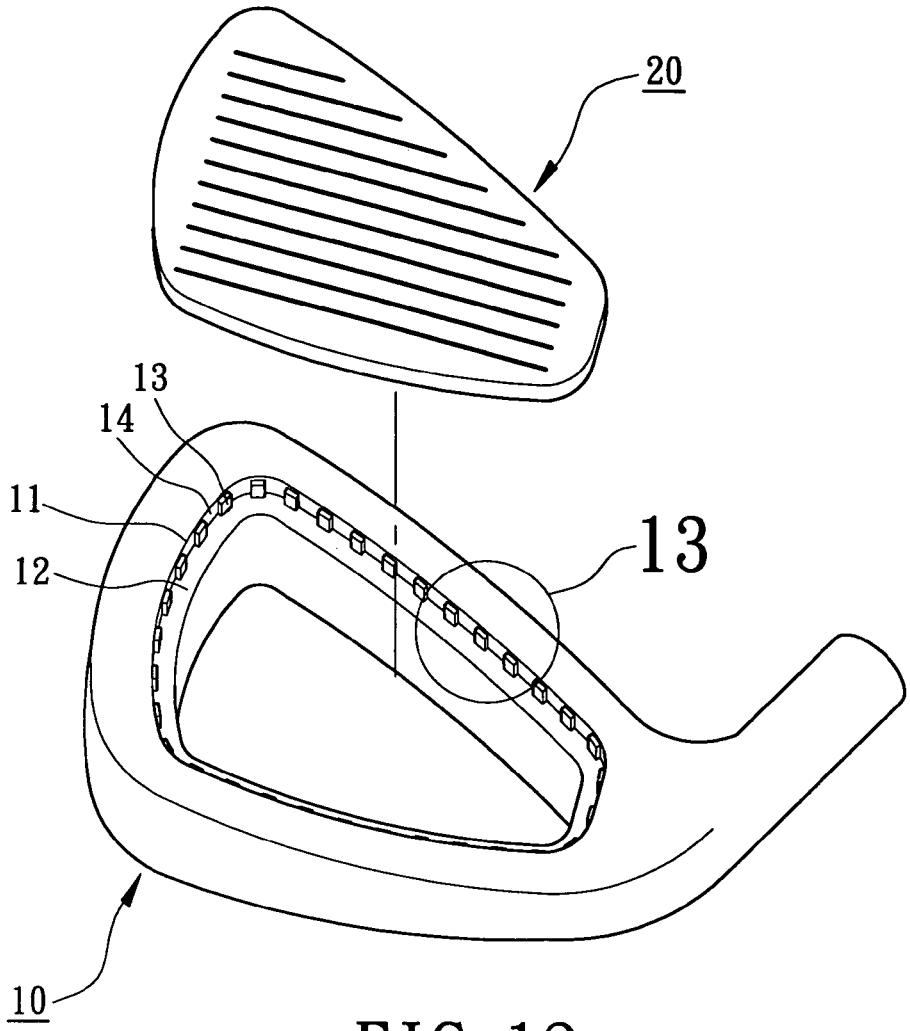
FIG. 12 is an exploded perspective view of a second embodiment of the golf club head in accordance with the present invention.
Figure 13:
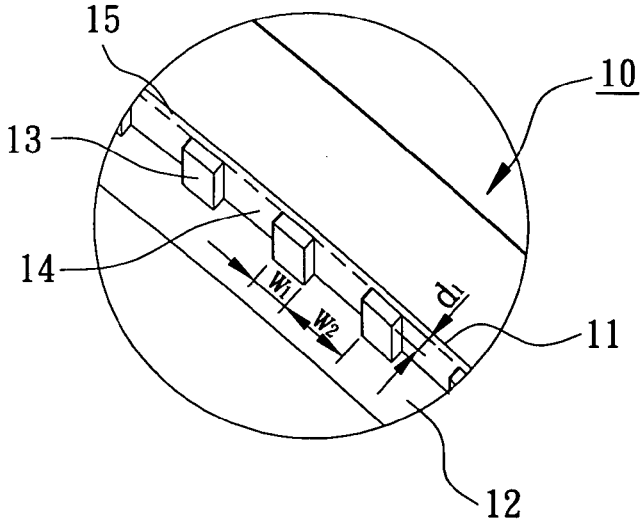
FIG. 13 is an enlarged view of a circled portion in FIG. 12.

Referring to FIGS. 12 and 13, a second embodiment of the golf club head in accordance with the present invention comprises a body 10 and a striking plate 20. The body 10 includes a recess 11 having a stepped portion 12. In this embodiment, a plurality of positioning protrusions 13 project from an inner perimeter delimiting of the recess 11 of the body 10, with a buffering space 14 being defined between two positioning protrusions 13 adjacent to each other. Each positioning protrusion 13 may be a parallelepiped, trapezoid column, semi-cylinder, or a triangular prism illustrated in the above embodiments. In this embodiment, each positioning protrusion 13 is a parallelepiped extending from a bottom edge of the inner perimeter delimiting the recess 11 toward a top edge of the inner perimeter delimiting the recess 11. As illustrated in FIG. 13, preferably, a space 15 for receiving filler is defined between each positioning protrusion 13 and a top edge of the inner perimeter delimiting the recess 11.

Further, a ratio of a width w1 of the respective positioning protrusion 13 to a width w2 of the respective buffering space 14 is preferably between 1:9 and 9:1. Further, a thickness d1 of each positioning protrusion 13 is preferably greater than a distance d2 between the inner perimeter delimiting the recess 11 of the body 10 and the perimeter of the striking plate 20. For the respective positioning protrusion 13, the thickness d1 of the positioning protrusion 13 is about 0.5 mm, preferably 0.3 mm, and most preferably 0.2 mm. This thickness d1 provides a tolerance of subsequent plastic deformation while inserting the striking plate 20 into the recess 11 of the body 10. Similar to the first embodiment of the present invention, the positioning protrusions 13 simplifies the assembling and positioning of the body 10 and the striking plate 20, improves the bonding strength, and reduces the manufacturing costs. Although not specifically illustrated, this embodiment may include other features of the above embodiments without adversely affecting the advantages of these and other features described and shown.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head comprising:

a body including a recess in a front side thereof; and a striking plate including a striking face on a front side thereof for striking a golf ball, a plurality of positioning protrusions projecting from an outer perimeter of the striking plate, said positioning protrusions being integrally formed on said outer perimeter and adapted to provide a tolerance in an assembling step so as to define a welding channel thereof, and connected to said recession of said body in a welding step by welding portion formed on said welding channel such that said welding portion securely mounts said striking plate in said recess of the body by said positioning protrusions and said outer perimeter of the striking plate being welded to an inner perimeter of the recess of the body;

wherein when the striking plate is initially inserted into the recess of the body in the assembling step, said positioning protrusions plastically deform and securely engage with the inner perimeter delimiting the recess to prevent said striking plate from falling off from said recess of said body, after the assembling step, for aiding welding operation, thereby positioning the striking plate in the recess and simplifying assembling and positioning for a subsequent welding procedure, said positioning protrusions being disposed in a gap of said welding channel formed between the recess of the body and the striking plate.

2. The golf club head as claimed in claim 1, wherein the recess includes a stepped portion for supporting the striking plate.

3. The golf club head as claimed in claim 1, wherein each of said plurality of positioning protrusions projects to a position that is outside the recess and that has a distance of 0.5 mm–0.2 mm to the inner perimeter delimiting the recess for plastic deformation.

4. The golf club head as claimed in claim 1, wherein two of said plurality of positioning protrusions adjacent to each other have a buffering space therebetween, a ratio of a width of the respective positioning protrusion to a width of the respective buffering space is between 1:9 and 9:1.

5. The golf club head as claimed in claim 1, wherein each of said plurality of positioning protrusions has an inclined face on a bottom side thereof for guiding said plurality of positioning protrusions into the recess of the body.

6. The golf club head as claimed in claim 1, wherein the striking face and said plurality of protrusions define a space for receiving filler.

7. The golf club head as claimed in claim 1, wherein each of said plurality of positioning protrusions is one of a parallelepiped, trapezoid column, semi-cylinder, and a triangular prism.

8. The golf club head as claimed in claim 1, wherein said subsequent welding procedure is one of manual welding and automated welding.

9. The golf club head as claimed in claim 1, wherein said subsequent welding procedure is one of braze welding, argon welding, laser welding, electric beam welding, and plasma welding.

10. The golf club head as claimed in claim 1, wherein the positioning protrusions are in a same plane as the striking plate.

11. The golf club head as claimed in claim 1, wherein said body is made from a first metal material and said striking plate is made from a second metal material such that said welding portion connects between said first metal material and said second metal material.

* * * * *